US006470534B2

(12) United States Patent
Kim

(10) Patent No.: US 6,470,534 B2
(45) Date of Patent: Oct. 29, 2002

(54) MANUFACTURING METHOD FOR CARDED WOOLEN YARN

(75) Inventor: Ki-Whan Kim, Seoul (KR)

(73) Assignee: Young Nam Textile Co., Ltd., Seoul (KR)

( * ) Notice: Subject to any disclaimer, the term of this patent is extended or adjusted under 35 U.S.C. 154(b) by 0 days.

(21) Appl. No.: 09/989,138

(22) Filed: Nov. 21, 2001

(65) Prior Publication Data

US 2002/0059702 A1 May 23, 2002

(30) Foreign Application Priority Data

Nov. 23, 2000 (KR) ..... 2000-69771

(51) Int. Cl.[7] ..... D01H 5/74

(52) U.S. Cl. ..... 19/261; 19/65 A; 19/98; 19/150

(58) Field of Search ..... 19/1, 2, 65 A, 19/98, 105, 107, 115 R, 145, 145.7, 150, 157, 236, 239, 244, 253, 260, 261, 258

(56) References Cited

U.S. PATENT DOCUMENTS

| | | | | | |
|---|---|---|---|---|---|
| 4,128,398 | A | * | 12/1978 | Alpert | 8/127.6 |
| 5,481,864 | A | * | 1/1996 | Wright | 19/107 |
| 5,535,488 | A | * | 7/1996 | Yao et al. | 19/239 |
| 5,638,580 | A | * | 6/1997 | Kim | 19/236 |
| 5,950,413 | A | * | 9/1999 | Scheerer et al. | 19/236 |
| 6,237,315 | B1 | * | 5/2001 | Huffman | 19/150 |

* cited by examiner

*Primary Examiner*—Danny Worrell
*Assistant Examiner*—Gary L. Welch
(74) *Attorney, Agent, or Firm*—Jacobson Holman PLLC

(57) ABSTRACT

A top making apparatus is attached to a woolen card. Materials usually to be processed on a woolen card are fed and the delivered web is guided by the top making apparatus and ball tops are formed by the top making apparatus. This top is processed on cotton spinning system. Finer and even yarn can be spun with the top.

8 Claims, 4 Drawing Sheets

MANUFACTURING METHOD FOR CARDED WOOLEN YARN

BACKGROUND OF THE INVENTION

1. Field of the Invention

The present invention relates to the filed of carded woolen yarn and in particular, a manufacturing method for carded woolen yarn.

2. Description of the Background

Woolen yarns are spun on a woolen spinning system which is composed of a woolen card and a mule spinning machine. Dyed fibers are fed to a woolen card and a bundle of slivers is produced by splitting a card web. Woolen yarn is spun on a mule spinning machine with these slivers. This woolen spinning system is simple and effective to spin fibers of a short length which can not be spun on a worsted spinning system. But only coarser count of yarn can be spun on this system. More over, the yarn evenness is not good and the strength of yarn is inferior. Especially, finer yarn spun on this system requires a stiff cost increase because of a sharp drop in productivity. Usually, single yarn is applied to make sweaters, resulting in a distortion of the garment. Finer yarn can be produced with the same dyed short fibers by this invention. This finer yarn can be plied with comparatively low cost. Sweaters made with this doubled and twisted yarn have better appearance without distortion of the fabric.

SUMMARY OF THE INVENTION

Various fibers of shorter length are dyed in a loose fiber dyeing machine, dried, oiled and fed to a conventional wool card, in front of which a top making apparatus is attached to receive the web which is flowing out from the doffer of a final mountain. The web is converted at the top of the ball shape. This top is fed to the draw frame of the cotton system. After four passage of drawing, the sliver are fed to the roving frame to make the roving. On a spinning frame, woolen yarn is spun with this rovings.

Parallel of fiber is improved by drawing. The yarn has better evenness and strength. Much finer yarn can be acquired with short fibers which are not suitable for the worsted spinning.

DETAILED DESCRIPTION OF THE PREFERRED EMBODIMENT

Figure 1:
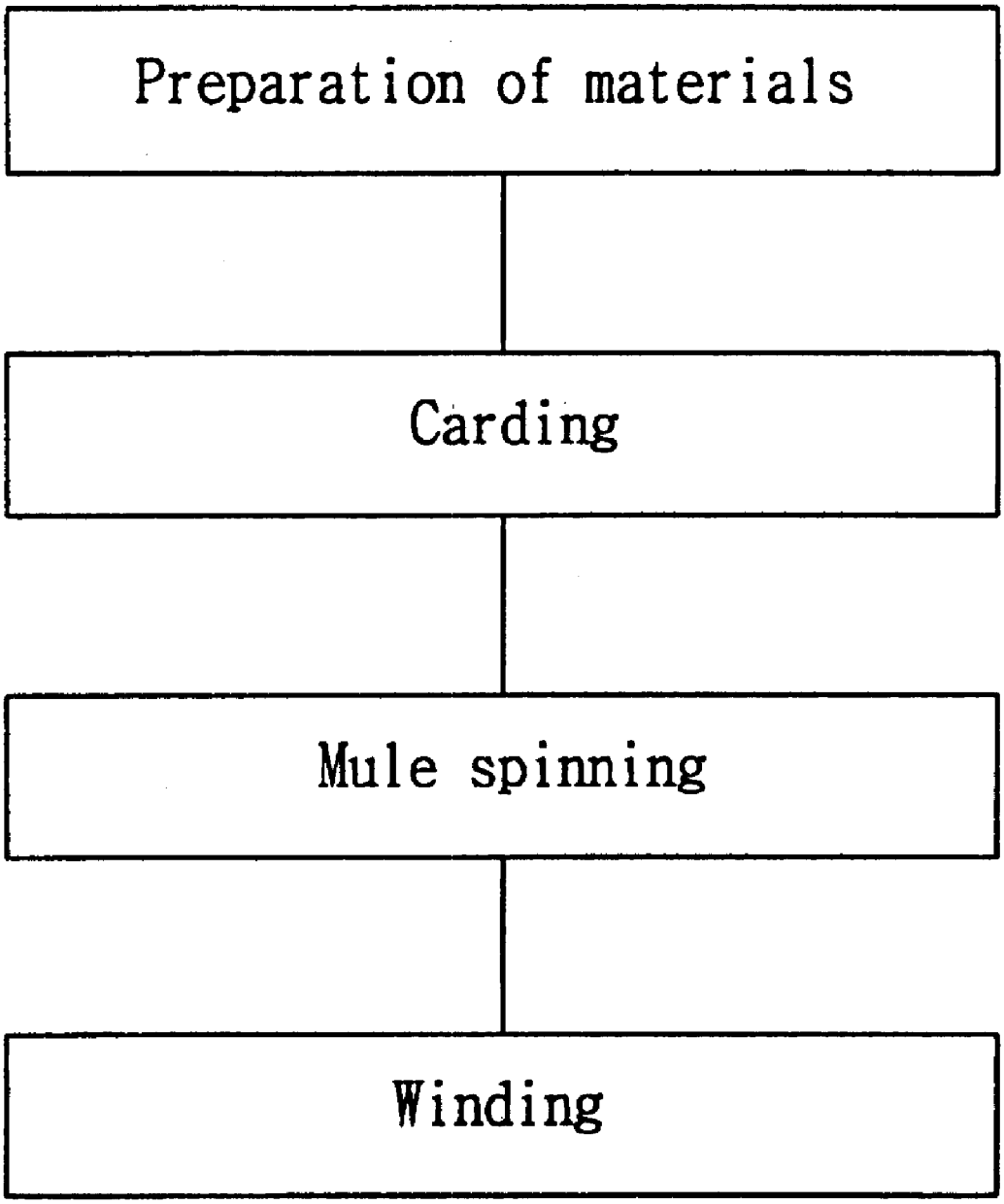
FIG. 1 A PRIOR ART
FIGS. 1A and 1B shows process of conventional woolen and cotton spinning.
Figure 1B:
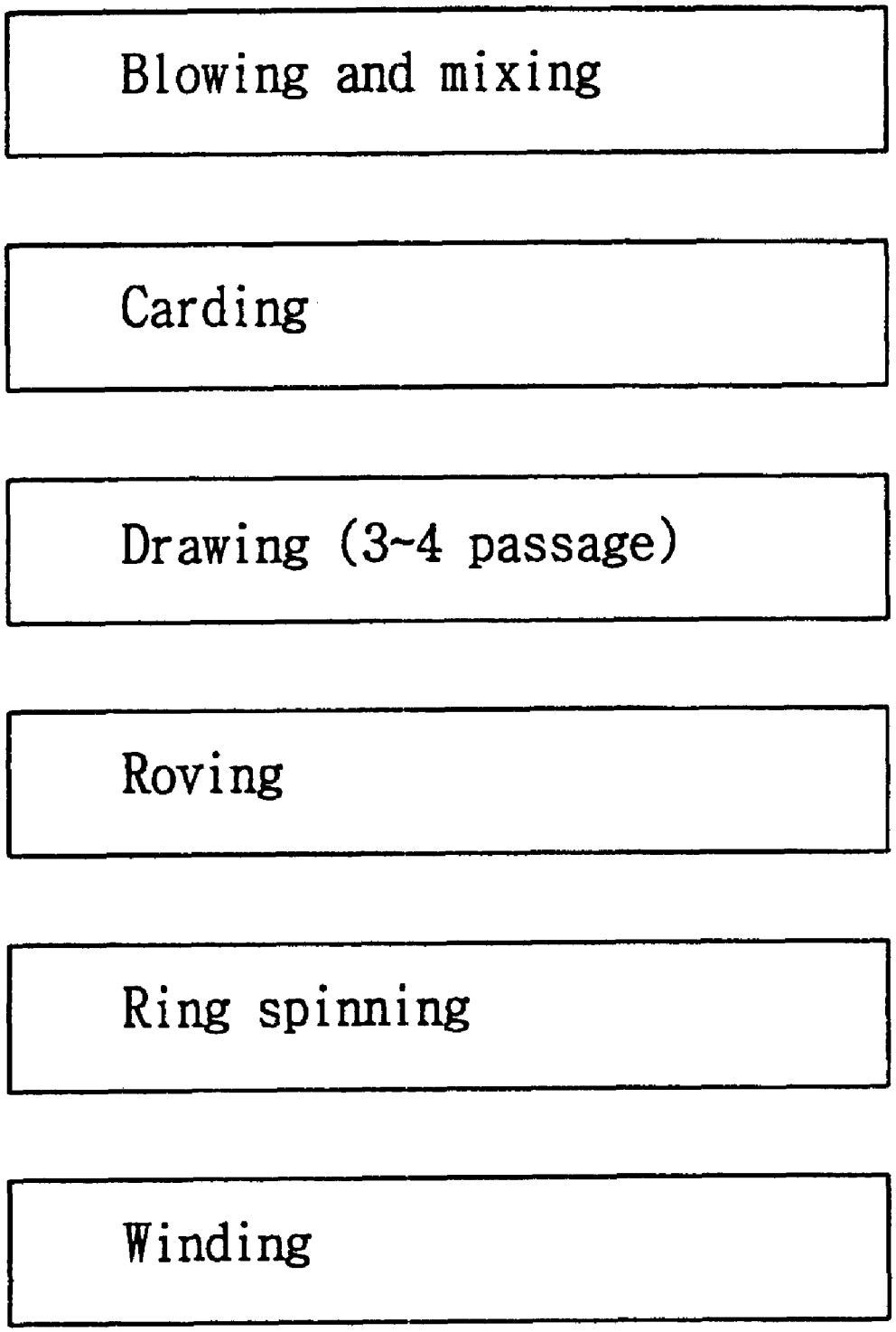
FIG. 1B PRIOR ART
Figure 2:
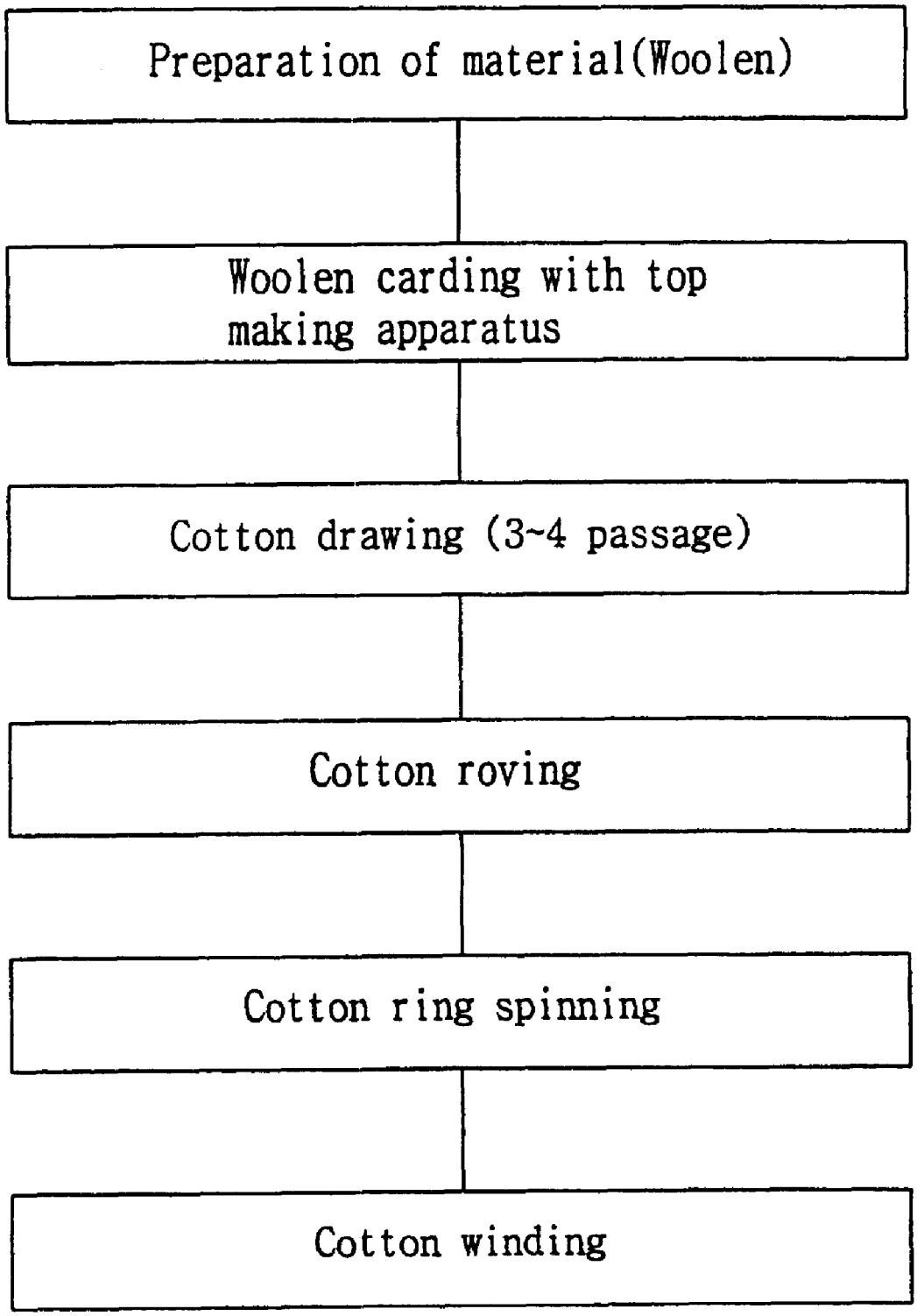
FIG. 2 shows process of spinning by the present invention.

The primary object is to spin a finer yarn, that is, 1/30 or a finer count with short fibers like lamb's wool, cashmere, carbonized pieces wool, etc, whose usual yarn count is coarser than 1/15. These fibers are not suitable to process on a worsted spinning system because of the shortness of the fiber length, and of course, not suitable to process on a cotton spinning system because these are too long and it is too difficult to open the fibers. The woolen card is effective and convenient to process the dyed and blended fibers. The sliver splitted and delivered to make a bundle is processed on a mule spinning frame. This system has only two processes to make the yarn from the fed materials. It is very simple and cost effective.

Generally, worsted yarns are doubled and twisted for making sweaters to have a good appearance and to prevent distortion. But the woolen yarns are too coarse to make doubled yarn. Also, woolen yarns are too weak for weaving. To make finer yarn on woolen system, the size of a sliver from the woolen card must be reduced according to the yarn count. So if a yarn number is finer by one-half, the production rate of the sliver from the card is reduced by one-half. As the sliver size is thinner and weaker, the speed of the doffer must be slower. So the combined effect of these two factors reduces the production rate much more than a reduction rate of the yarn size. The decrease of production rate of mule spinning is the same as reduction of yarn size, with woolen card. Those reductions of production rate make the yarn cost rise sharply. Additionally, the finer wool must be selected to spin finer yarn and this adds to the cost of the already expensive production.

With reference now to the Figures. The groove roller has bottom roller 1, non-cut area of top roller boss 2, cut area of top roller boss 3, straight apron 4, and bent apron 5 by fiber fleece which is being passed between bottom roller/and top roller 2.

In this invention, the delivered web is taken from the doffer of the last mountain to make a ball top by means of a top making apparatus. The top making apparatus is attached to the woolen card which is the same apparatus as attached to the worsted card. The top is fed on the draw frame of the cotton spinning system. The fiber length of the top is much longer than that of cotton.

Figure 3:
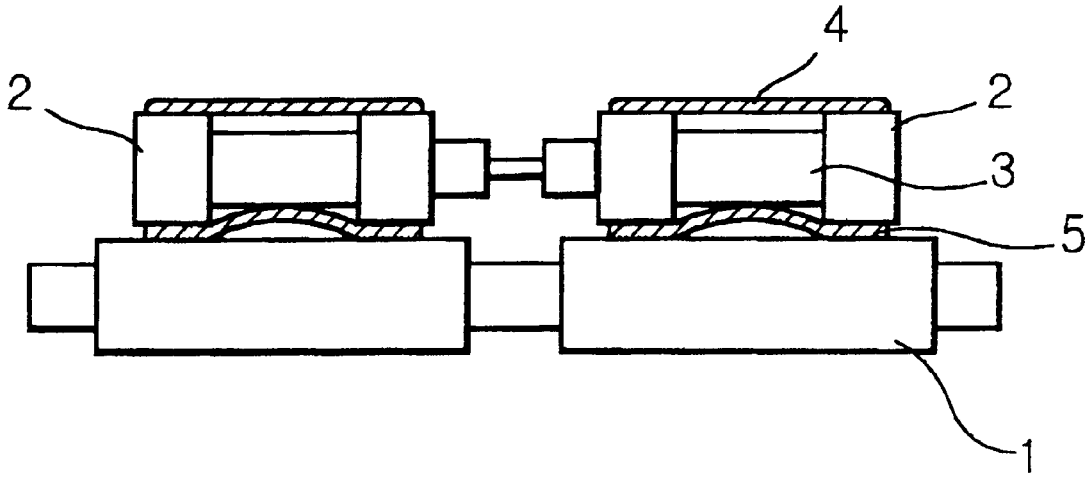
FIG. 3 shows a recessed area of a cut boss and a state of action of a fiber fleece against an apron.

In the prior art, fibers which are longer than 51 mm cannot be processed on cotton draw frame, roving frame, and ring frame. Because of this obstacle, materials for woolen yarn has not spun on cotton system, and to get rid of this obstacle is main point of the invention. Fibers which are contained in the top from the woolen card of this invention are longer than 51 mm (some times longer than 150 mm). To process these long fibers, the breaking of fibers must be practiced in the drawing process with cotton draw frame. The art of breaking wool fiber is the same as that of U.S. Pat. No. 5,638,580. The fibers can be broken by stretching power generated from the nipping pairs of rollers which are pressed with spring coils, if the weight of fibers which are nipped by feeding pairs of rollers and delivering pairs of rollers at the same time is less than 10% of total fiber weight. The distance between two nipping pairs of rollers is determined by finding out the distance, by which the weight of fibers nipped by two pairs of rollers is obtained less than 10% of the total weight. Trial and error method is rather practically useful to find out the suitable distance. If the distance is too wide, an irregular strand of unbroken fibers of wool is seen in the sliver produced. The distance is adjusted until an even web of sliver is produced. The fiber length is reduced gradually according to the preceeding passage of drawing. The fibers consisting slivers from last passage of drawing should have more uniform fiber length and longer mean length. Materials for woolen yams are two groups: one is wool majority; the other is chemical fiber majority with cotton. The longest fiber length of wool group may be adjusted as more than 60 mm according to fiber length distribution of top, and suitable longest length may be selected in the range of 40/60 mm according to fiber length distribution of top for chemical fibers and cotton. To get wider distance on draw frame the last passage is fed on the roving frame. The slivers whose longest fiber length is less than 60 mm can be processed with regular rollers and adjusting the distance between $1^{st}$ and $2^{nd}$ pairs of 60/110 mm between $1^{st}$ and $3^{rd}$ pairs of rollers according to the longest of fibers in the sliver and the $2^{nd}$ top rollers which are replace with recessed rollers shown in FIG. 3. These recessed roller make tunnels. Non-recessed part(2) of a recessed roller drives apron(4). The strand of fibers are passed between the bottom roller(1) and recessed part the of the recessed roller with apron(5) which is bent by the pressure generated by the fiber strand. The roving produced from the roving frame is processed on the ring frame to make yarn. If the longest fiber length is longer than 55 mm, the grooved middle top rollers are applied. The drafting ratio is much less compared to conventional cotton spinning, and twist per meter is higher than regular woolen yarn by 10–15%.

This extra twist is untwisted by doubling and twisting.

A cotton system is inconvenient to process dyed fibers like cotton, rayon and nylon blending with wool because changing of a small lot size is almost impossible on a blowing and carding machine of the cotton system. By this invention, the convenient and effective woolen card is utilized to process almost any fiber to get a good quality of the woolen yarn. Concerning the transferring of the material from the woolen card to the drawing frame, other methods can be applied, for example, the delivering of web from the doffer of the woolen card which can be condensed and coiled to a can.

EXAMPLE 1

Carbonized lambs wool (18 micro m. longest fiber length of 90 mm) 30% carbonized pieces wool (18 micro m, longest fiber length of 90 mm) 30%, wool top (18 micro m, longest fiber length of 150 mm) 40% was mixed, dyed, and oiled with conventional method in woolen spinning. The dyed fibers were fed to the four mountain woolen card which was newly equipped with top making apparatus and the ball tops were made instead of bundle of thin sliver from the conventional woolen card (important process in the invention).

These ball tops were fed to the cotton drawing frame adjusting the distance between $1^{st}$ and $3^{rd}$ rollers as 110 mm at $1^{st}$ passage, $2^{nd}$ passage, $3^{rd}$ passage, and last passage making the longest fiber length 110 mm (fibers longer than 110 mm are cut), producing a sliver with the conventional method. The slivers were processed on the cotton roving frame. The distance between $1^{st}$ and $2^{nd}$ rollers was set as 60 mm. The distance between $1^{st}$ and $3^{rd}$ rollers was set as 110 mm and normal $2^{nd}$ top rollers were replaced with recessed rollers on the roving frame for producing rovings with the conventional method. These rovings were fed on a ring spinning frame, on which the rovings were drafted to thinner strands of wool fibers making yarn of 1/30. The distance between the $1^{st}$ and $2^{nd}$ pairs of rollers was set as 60 mm, the distance between $1^{st}$ and $3^{rd}$ pairs of rollers was set as 110 mm and recessed rollers were adapted as one roving frame. The twist per meter was set as 540, R.P.M. as 8.000. The spun yarn was doubled and twisted with T.P.M. of 200. Sweaters were made with flat knitting machine of 12 gauge. The sweaters were with good appearance and good handle with no distortion.

EXAMPLE 2

10% of cashmere, 40% of carbonized wool (20 micron, 90 mm of longest fiber length) 30% of rayon (2d×b1 mm), 20% of nylon (2d×51 mm) was mixed, dyed and oiled. The fibers were fed to the woolen card equipped with a top making apparatus in making the ball top. The top balls were fed to the conventional cotton draw frame. The distance between the $1^{st}$ and $3^{rd}$ pairs of rollers was set as a 64 mm to stretch and cut wool fibers which were longer than 64 mm. At the $1^{st}$ passage of drawing, releasing pressure which was applied on the $2^{nd}$ pairs of rollers is necessary. The distance between the $1^{st}$ and $2^{nd}$ pairs of rollers was set as 55 mm on the drawing frame of the $2^{nd}$ passage to stretch and cut already shortened wool fibers at a prior passage. The distance between the $1^{st}$ and $2^{nd}$ pairs of rollers was set as 55 mm as the length of all the fibers were less than 55 mm on the drawing frame of the $3^{rd}$ and last passage. Conventionally, the roller gauge for a chemical fiber having a fiber length of 51 mm must be set as 51+2 to 51+4 mm. The sliver which was produced on the drawing frame of the last passage was fed on the cotton roving frame. The distance between $1^{st}$ and $2^{nd}$ pairs of rollers was set as 55 mm on the roving frame as conventional method with regular rollers producing rovings. These rovings were fed to the cotton ring frame. The distance between $1^{st}$ and $2^{nd}$ pairs of rollers was set as 55 mm with regular rollers. Yarn of 1/36 was spun with 9,000 R.P.M. of spindle speed and 590 T.P.M. The yarn was doubled and twisted with T.P.M. of 230. A Sweater was knitted with a flat knitting machine of 16 gauge. The sweater was with good quality, finer texture and handle of cashmere.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A manufacturing method for woolen yarn of fine count with materials which are used to make woolen yarn on combined system of woolen card and cotton system comprising the steps of:

preparing dyed or raw materials by means of conventional woolen system, feeding said materials to the woolen card, condensing said materials into a web from a doffer of the woolen card, forming coiled sliver in a can to transfer to a drawing frame of the cotton system, drawing the sliver on said drawing frame, adjusting the spacing between two nipping rail pairs to get fibers having a more uniform length and longer mean length, with which the fibers can be drafted on a roving frame and ring frame, adjusting the spacing between roller pairs of main draft zone of the drawing frame for a first passage, getting a required length gradually through a second passage, producing roving on the roving frame with the sliver produced from the second passage of said drawing, using recessed rollers of the second pair only when the longest length of fibers is longer than 60 mm, using recessed rollers of said second pair, spinning yarn with the roving frame, re-adjusting the distance between pairs of said first and second rollers, and using top rollers of said second pair only when the longest length of fibers is shorter than 60 mm.

2. The method for woolen yarn according to claim 1, further comprising the step of:

utilizing said woolen card to process fiber for woolen yarn.

3. The method for woolen yarn according to claim 1, wherein said fiber consists of at least one of lamb's wool, carbonized pieces of wool, wool pieces, wool top, angora, alpaca, cotton, acrylic, and polyester.

4. The method for woolen yarn according to claim 1, wherein said fiber consists of at least one of cashmere, carbonized wool, rayon, and nylon.

5. The method for carded woolen yarn according to claim 1, further comprising the steps of:

processing said sliver on said drawing frame with a roller gauge of 64 mm, performing a second processing of said drawing with a roller gauge of 55 mm, and performing a third processing of said drawing with said roller gauge of 55 mm.

6. The method for woolen yarn according to claim 5, wherein said roller setting is applied with a spinning frame with the 55 mm roller gauge.

7. The method for woolen yarn according to claim 5, wherein said roller setting is applied with a spindle speed of 9,000 rpm.

8. The method for woolen yarn according to claim 5, wherein said roller setting is applied with and a yarn count of 1/36.

* * * * *